US008257055B2

(12) United States Patent
Beg et al.

(10) Patent No.: US 8,257,055 B2
(45) Date of Patent: Sep. 4, 2012

(54) SYSTEM AND PROCESS FOR PUMPING MULTIPHASE FLUIDS

(75) Inventors: Mirza Najam Ali Beg, Milton Keynes (GB); Mir Mahmood Sarshar, Beaconsfield (GB)

(73) Assignee: Caltec Limited, Bedford (GB)

( * ) Notice: Subject to any disclaimer, the term of this patent is extended or adjusted under 35 U.S.C. 154(b) by 1102 days.

(21) Appl. No.: 10/550,225

(22) PCT Filed: Mar. 17, 2004

(86) PCT No.: PCT/GB2004/001123

§ 371 (c)(1),
(2), (4) Date: Aug. 2, 2006

(87) PCT Pub. No.: WO2004/083601

PCT Pub. Date: Sep. 30, 2004

(65) Prior Publication Data

US 2007/0158075 A1 Jul. 12, 2007

(30) Foreign Application Priority Data

Mar. 22, 2003 (GB) ..... 0306646.1

(51) Int. Cl.
*F04B 23/08* (2006.01)

(52) U.S. Cl. ..... 417/87; 166/75.12; 166/75.11

(58) Field of Classification Search ..... 166/75.12, 166/75.11, 105.5, 105.6; 417/87
See application file for complete search history.

(56) References Cited

U.S. PATENT DOCUMENTS

| | | | | |
|---|---|---|---|---|
| 3,590,919 | A * | 7/1971 | Talley, Jr. | 166/357 |
| 3,782,463 | A * | 1/1974 | Palmour | 166/68 |
| 4,222,763 | A * | 9/1980 | McMaster | 65/287 |
| 4,718,824 | A * | 1/1988 | Cholet et al. | 417/14 |
| 4,762,467 | A * | 8/1988 | Ackermann et al. | 417/54 |
| 4,988,389 | A | 1/1991 | Adamache et al. | |
| 5,390,740 | A * | 2/1995 | Woerheide | 166/266 |
| 6,132,494 | A | 10/2000 | Kjos et al. | |
| 2002/0139248 | A1 | 10/2002 | Choi et al. | |
| 2004/0154794 | A1 * | 8/2004 | Appleford et al. | 166/267 |

FOREIGN PATENT DOCUMENTS

GB 2 014 862 9/1979

(Continued)

OTHER PUBLICATIONS

International Search Report dated Jun. 29, 2004.

(Continued)

*Primary Examiner* — Charles Freay
*Assistant Examiner* — Christopher Bobish
(74) *Attorney, Agent, or Firm* — Knobbe Martens Olson & Bear LLP

(57) ABSTRACT

A system for pumping multiphase fluids includes a phase separator (14), a gas-gas jet pump (30) and a liquid pump (36). The phase separator (14) receives a LP multiphase fluid and separates a LP gas phase and a LP liquid phase from the LP multiphase fluid. The gas-gas jet pump (30) receives the LP gas phase from the phase separator (14) and a HP gas supply from a sustainable gas source, and has an outlet providing outlet gas at a pressure higher than that of the LP gas phase. The liquid pump (36) receives the LP liquid phase from the phase separator (14), and has an outlet providing outlet liquid at a pressure higher than that of the LP liquid phase.

23 Claims, 4 Drawing Sheets

FOREIGN PATENT DOCUMENTS

| | | | |
|---|---|---|---|
| GB | 2 239 676 | | 7/1991 |
| RU | 2014514 | C1 | 6/1994 |
| RU | 2016265 | C1 | 7/1994 |
| WO | WO 95/07414 | | 3/1995 |
| WO | WO 00/75510 | | 12/2000 |
| WO | WO 02/18746 | | 3/2002 |

OTHER PUBLICATIONS

Great Britain Search Report dated Oct. 27, 2003.

* cited by examiner

SYSTEM AND PROCESS FOR PUMPING MULTIPHASE FLUIDS

This application is the U.S. National Phase under 35 U.S.C. §371 of International Application PCT/GB2004/001123, filed Mar. 17, 2004, which claims priority of GB 0306646.1, filed Mar. 22, 2003.

The present invention relates to a system and process for pumping multiphase fluids, and in particular but not exclusively to a system and process for sustainable oil production boosting.

Production from many oil and gas fields is restricted as the reservoir pressure drops during the field life. Generally, the producing wells have to operate at a pressure which is demanded by the downstream process or pipeline system and the flowing wellhead pressure can not be dropped below this limit in order either to maintain production or to increase production and recovery from the field. Under these conditions a pressure boosting system is required so that the reduction in the back pressure on wells or the flowing wellhead pressure is achieved while meeting the downstream process or pipeline pressure requirements.

The productivity of wells within a production system or field varies for a number of reasons such as fragmentation of the reservoir, where production comes from different zones or from satellite fields. In these cases it is very common that some wells are classed as good high pressure producers while some could be poor low pressure wells.

In many conventional production systems the flow from all producing wells is combined in a manifold and the total products enter one or a series of separators. These separators separate primarily gas and liquid phases. The pressure of the separated gas is in most cases boosted using compressors to achieve a high pressure which is needed either for export of the gas by pipeline or to allow the gas to be used for other purposes, such as for use as lift gas or for injection into the reservoir to maintain the reservoir pressure.

The compressors are designed with a minimum required inlet pressure and it is this pressure which dictates the operating pressure of the separators upstream of the compressors. As the pressure of the reservoir drops, the required minimum inlet pressure for the compressors becomes a limiting factor as the flowing wellhead pressure of the producing wells cannot be allowed to drop further to maintain or increase production. This situation may also apply to fragmented reservoirs or fields with satellites which in part may have a different productivity level or permeability compared to the rest of the field. In this case it is these parts or wells from these low pressure fragmented parts that need boosting. However, lowering the inlet pressure of compressors reduces their gas handling capacity and it is therefore not often desired or possible.

Furthermore, upgrading of such compressors so that a lower inlet pressure can be handled (providing a lower back pressure on the wells and more production) is a very costly operation and also requires a long lead time. Although this upgrading is done in some fields which are in the later stage of their production life, this upgrading is not considered for many marginal fields because of its high cost.

In these circumstances a boosting system which would allow some or all the low pressure wells to operate at a lower back pressure (and therefore a higher production rate) would be highly desired. Such a boosting system would enable production from the selected low pressure wells to be increased without the need to spend large sums upgrading the entire production system. Even in cases when the final upgrading of the process and compression system takes place, such projects often take two years or more to complete and interrupt production during this period. A boosting system that could be implemented at relatively low cost would be well justified as an interim solution, because the boosting system would pay for the capital spent within a few months while the remaining time would bring added revenue to the operator.

There are a variety of ways by which the boost in pressure or the reduction in the back pressure on producing wells can be achieved. The selection of a suitable system is affected by field conditions and constraints such as the space and weight constraints or power constraints and the economic aspects which relate to key parameters such as the capital cost, operation cost, increase in production and revenue and factors such as payback period for the investment made.

An ideal system is one that is of relatively low cost, simple to operate and reliable, while delivering the boost required.

Boosting the production of oil involves handling both gas and liquid phases as in practically all cases the produced oil is in multiphase form (containing gas and liquid phases). In order to increase the pressure of the produced fluids the boosting system has to be capable of handling the multiphase mixture, requiring equipment such as multiphase pumps. Alternatively the gas and liquid phases can be separated and a separate boosting system is used for each phase. This means, for example, using a gas compressor for boosting the gas phase and a liquid booster pump for the liquid phase. The so called multiphase booster pumps that can handle both gas and liquid phases are complex and costly units and the operation conditions they face and have to cope with are the main cause of their complexity and high cost. Some typical operating requirements for such pumps are:

Handling two phase flow

Coping with chaotic fluctuating flow regimes associated with multiphase flow such as slug flow.

The ability to run for a short period of time with 100% gas and no liquid phase. This condition again is often generated as a result of flow regime or slugging in pipelines in inclined, horizontal or vertical configuration.

The ability to handle a large volume of gas compared to the associated liquid phase. This is particularly true for low pressure wells (as the volume of gas increases as the pressure decreases) and wells that are gas lifted (where gas is injected within the well bore to reduce the hydrostatic head of the fluids in the well bore and maximise the flowing wellhead pressure). In most cases the gas/liquid ratio of the mixture at the operating conditions ranges from 9 to 49 or higher. This means that the volume of the gas as the percentage of the total mixture is between 90% and 98% or higher.

The relatively large volume of gas compared to the liquid phase alone raises the power requirement for the multiphase pump by several fold and in some cases ten fold or more. This large power requirement is a major setback for many fields, and particularly on satellite platforms, which do not have sufficient power available for this purpose. A typical range of the power required for multiphase pumps is 200 kW to 1000 kW and in some cases even higher, reaching 2 to 3 megawatt, most of which is caused by the large volume of gas involved.

An alternative system which uses a jet pump and was the subject of European Patent No. 0717818, uses high pressure (HP) wells as the source of energy to reduce the back pressure on low pressure (LP) wells and thus increase their production rate while meeting the downstream system pressure requirement. This system works satisfactorily in many applications but has limitations when either:

- the gas volume fraction of the LP wells is very high;
- the available high pressure wells are not likely to maintain their high pressure for long, or
- the pressure and flow rate of high pressure wells are not significantly higher than those of the selected LP wells.

Another boosting system, which is marketed under the trade name Wellcom Boost, includes an option as shown in FIG. 1 where a multiphase gas and oil mixture from one or more LP wells is supplied through a manifold 2 to a separator 4, which in this case is a compact cyclonic type separator. The gas and liquid phases are separated and a booster pump 6 is used to boost the pressure of the LP liquid phase. This boosted liquid phase is fed to the HP inlet of a jet pump 8 and is used as the motive flow. The separated LP gas is fed through a bypass line 10 to the LP inlet of the jet pump 8. The LP gas pressure is boosted by the jet pump 8 to deliver a gas/liquid mixture into a pipeline 12 at the required discharge pressure.

A drawback of this system is that it does not operate satisfactorily in conditions when the volumetric flow rate of the LP gas is high in comparison with the volumetric flow rate of the boosted liquid phase. Typically, when the volumetric flow rate of the LP gas at the operating pressure and temperature is more than twice that of the liquid phase the effectiveness of the jet pump system drops significantly, making the system unattractive and uneconomical. In practically all oil fields the ratio of gas to liquid flow rate is well above 2 at the operating conditions (often between 5 to 50) so the system shown in FIG. 1 has a very limited application.

If other conventional boosting options are used, such as using a liquid booster pump (for the liquid phase) and a compressor (for the separated gas phase), the system becomes highly complex and costly as a result of the need to have a separation system to separate gas and liquid phases as well as the compressor and the booster pump. In this case the compressor is the major cost item, which brings about further drawbacks including requiring considerable space, high maintenance requirements and a long lead delivery period.

According to the present invention there is provided a system for pumping multiphase fluids, the system including a phase separator that is connected to receive a LP multiphase fluid, and is constructed and arranged to separate a LP gas phase and a LP liquid phase from the LP multiphase fluid; a gas-gas jet pump having a LP inlet connected to receive the LP gas phase from the phase separator, a HP inlet connected to receive HP gas supplied from a sustainable gas source, and an outlet for providing outlet gas at a pressure higher than that of the LP gas phase; and a liquid pump having a LP inlet connected to receive the LP liquid phase from the phase separator, and an outlet for providing outlet liquid at a pressure higher than that of the LP liquid phase.

The sustainable gas source may be from a supply of lift gas or export gas or other sources such as HP steam or underground steam from sources such as geothermal wells. The sustainable gas source may include a compressor. Advantageously, the sustainable gas source has a pressure at least twice, and preferably several times, that of the LP gas phase. Typically the pressure may be in the range 50-150 bar.

The gas-gas jet pump may typically have an outlet pressure in the range 1.1 to 3.0 times that of the LP gas, although it is not limited to this range.

The liquid pump may be a mechanical pump, and is preferably a positive displacement pump. The outlet pressure of the liquid pump is preferably similar to that of the gas-gas jet pump. The booster pump may also be a hydraulic drive type. Such pumps are driven by a power liquid phase instead of an electric motor. The power fluid may be high pressure oil or high pressure water such as injection water, which is available in some fields and is injected into some wells for the purpose of maintaining the reservoir pressure.

Alternatively, the liquid pump may be a liquid-liquid jet pump having a LP inlet connected to receive the LP liquid phase from the phase separator, a HP inlet connected to receive a HP liquid supply from a sustainable liquid source, and an outlet for providing outlet liquid at a pressure higher than that of the LP liquid phase. The sustainable liquid source may be injection water or a supply of export oil, or any other suitable HP liquid supply. The sustainable liquid source may have a pressure at least twice that of the LP liquid phase. The liquid-liquid jet pump preferably has an outlet pressure similar to that of the gas-gas jet pump.

The system may include a knock-out vessel for removing retained liquid from the separated LP gas phase. The knock-out vessel preferably has a liquid outlet connected to deliver the removed liquid to the liquid pump.

The separator may be a cyclone type separator.

The system may include a mixing device connected to the outlets of the jet pump and the liquid pump, for combining the outlet gas and the outlet liquid and providing a combined multiphase outlet fluid at a pressure higher than that of the LP multiphase fluid. The mixing device may be a commingler. In cases when there is a significant difference between the pressures of the outlet of the gas-gas jet pump and the booster pump a throttling valve may be installed on the outlet line of the higher pressure fluid to equalise the pressures.

The combined multiphase outlet fluid may have an outlet pressure in the range 1.1 to 3.0 times that of the LP liquid phase, although it is not necessarily limited to this range. The multiphase fluid is preferably a petroleum gas/oil mixture. The gas/liquid ratio of the low pressure petroleum gas/oil mixture may be in the range of 9 to 49, as dictated by field conditions, although it is not necessarily the limit of this range.

In some applications and depending on the field conditions the boosted gas and liquid phase may not be required to be combined. In this case the pressures of the two boosted fluids need not be similar and a commingler is not required in this case.

According to another aspect of the invention there is provided a process for pumping multiphase fluids, the process including separating a LP multiphase fluid into a LP gas phase and a LP liquid phase, increasing the pressure of the LP gas phase using a gas-gas jet pump by supplying a HP gas supply from a sustainable gas source to a HP inlet of the jet pump and supplying the LP gas phase to a LP inlet of the jet pump, and increasing the pressure of the LP liquid phase using a liquid pump.

The process may also include mixing the increased pressure gas and liquid phases to provide a combined multiphase fluid at a pressure higher than that of the LP multiphase fluid Further novel aspects of the invention include the following:

- A process by which energy from a high pressure gas or liquid source is used to boost the pressure of the produced fluids from one or more LP wells.
- A system consisting of a gas-liquid separator, a gas-gas jet pump, a booster pump and commingler in the arrangement shown in FIG. 2.
- A system which uses a sustainable source of high pressure gas as the motive flow to the jet pump (e.g. lift gas, steam or gas from geothermal wells if they exist).

A system with a pump which is capable of not only handling the liquid phase but can also handle some free gas. The need for gas handling capability arises for two main reasons:

a) the separated liquid phase is live unstabilised crude oil and is subject to the release of gas from the fluid as it passes along the pipework;

b) often as a result of inherent flow fluctuations (or flow regime) upstream and/or as a result of using compact separators such as cyclonic separators there is some carryover of the gas into the liquid phase.

An example of such a pump is the so called Positive Displacement (PD) pump such as twin screw type or progressive cavity type or any other type with such a capability.

A bypass pipeline system (with its associated control valve) for the pumping system which is used for two main functions:

a) to bypass the liquid flow into the pump at the start of the system operation (start-up) to ensure that the pump does not run with 100% gas at start-up;

b) to make it possible to recirculate some of the liquid in cases when the liquid flow rate handled by the pump is well below its optimum design value.

A set of check valves to prevent reverse flow from one line into the other. These are needed to protect the pump and the other components during any malfunctions.

A set of control valves downstream of the jet pump or the booster pump to equalise the pressures of the fluids before they are commingled in a commingler.

The use of sustainable HP liquid phase such as injection water or HP export oil as the motive flow for the liquid phase (option 2).

A system that reduces significantly the amount of gas to be handled by the multiphase pumps. The reduction in the amount of gas handled by the multiphase pump has the major advantage of reducing the size of the pump, reducing the power required for the pump significantly and reducing the cost because of the said reduction in size and power for the pump. It also has the advantage of enabling the boosting system to be used on locations where a large amount of electric power (100 to 2000 kW typically) is not available for use by the multiphase pumps alone.

A system that may use a hydraulically driven liquid booster pump to boost the pressure of the LP liquid phase. The power fluid may be oil, water or any other acceptable or available high pressure liquid.

Embodiments of the invention will now be described, by way of example, with reference to the accompanying drawings, in which.

Figure 1:
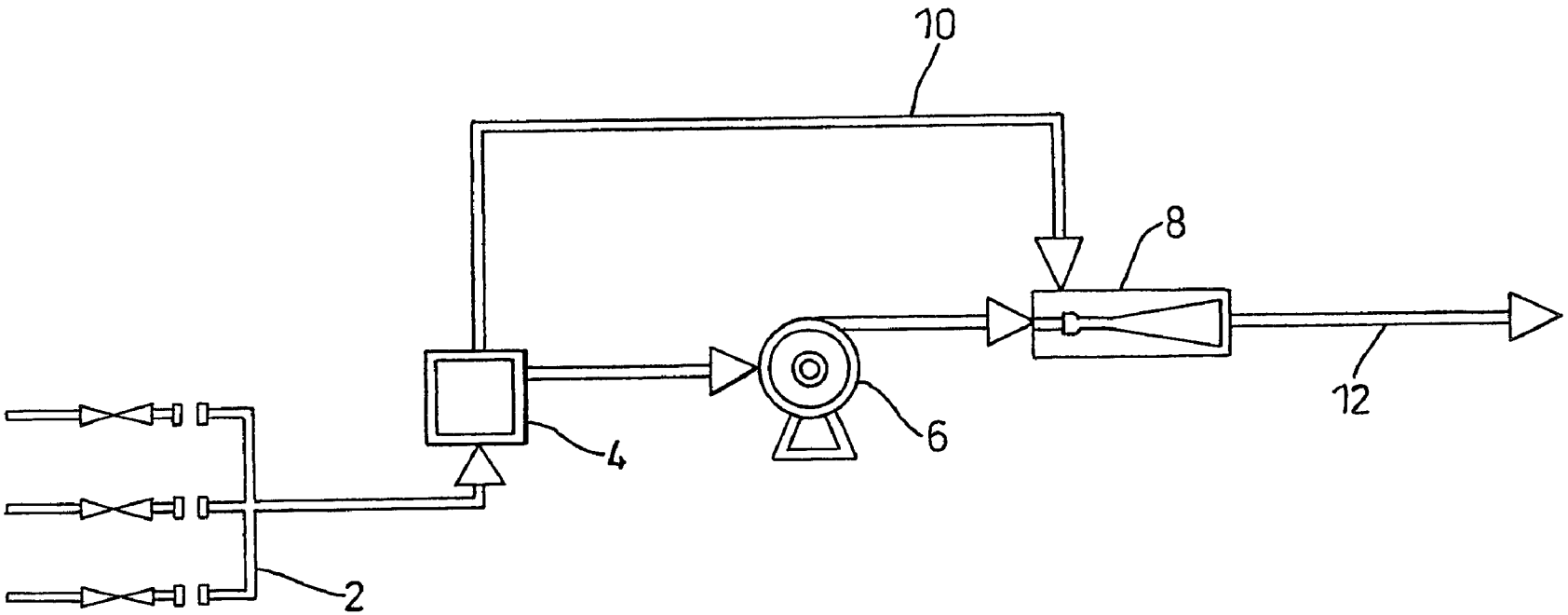
Fig. 1 (PRIOR ART)
FIG. 1 illustrates diagrammatically the general configuration of a prior art pressure boosting system, known as the WELLCOM BOOST system.
Figure 2:
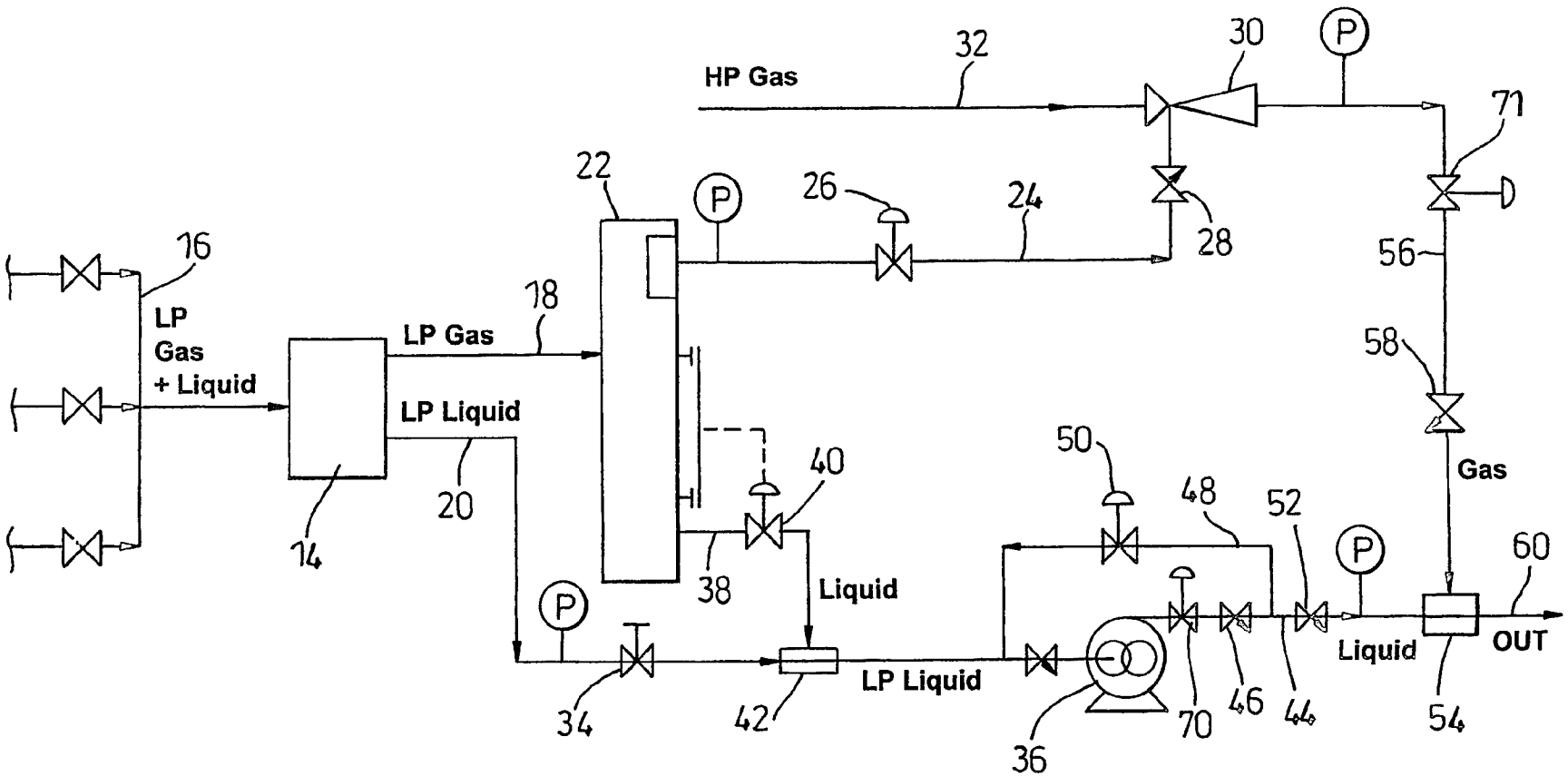
FIG. 2 shows the general configuration of a pressure boosting system according to a first embodiment of the invention.

The general layout and key components of the system are shown in FIG. 2. The system includes a separator 14, which is arranged to receive a multiphase fluid mixture (including gas and liquid phases) from one or more LP wells through a manifold 16. Preferably, the separator 14 is a compact cyclone separator, for example as described in European Patent Nos. 1028811 and 1028812. However, other types of separator may alternatively be used including, for example, a conventional gravity separator.

The separator 14 separates the gas and liquid phases, which leave the separator through a gas line 18 and a liquid line 20.

Preferably, a knock-out vessel 22 is provided downstream of the separator 14 to separate any small amounts of liquid that may be carried over by the separated gas phase. The clean LP gas leaves the knock-out vessel 22 through a gas line 24. Some carry over of liquid in the separated gas phase is often expected either because of flow fluctuations, which are common to multiphase flow in pipelines upstream of the system, or as a result of using a compact separator of any kind, as these are more sensitive to flow fluctuations. Alternatively, the knock-out vessel may be omitted, in which case the first gas line 18 is connected directly to the second gas line 24.

The clean LP gas passes via a pressure control valve 26 and a non-return valve 28 to the LP inlet of a gas-gas jet pump 30. The jet pump 30 receives the separated LP gas as the suction flow. High pressure gas is supplied to the HP inlet of the jet pump 30 through a HP gas line 32. The HP gas is preferably obtained from an existing sustainable high pressure source, such as a supply of lift gas or from the downstream side of an existing compressor. The HP gas may also be HP steam from any available source such as geothermal wells. The HP gas serves as the motive gas for the jet pump 30 and draws the LP gas through the gas line 24 to provide a combined gas flow at the outlet of the jet pump 30, which is at a substantially higher pressure than the LP gas.

The liquid phase leaves the separator 14 through the liquid line 20 and flows via a control valve 34 to a booster pump 36, which receives the separated liquid phase and boosts its pressure to that required by the downstream system. Any liquid separated from the LP gas in the knock-out vessel 22 flows through a liquid line 38 and a level control valve 40, and is recombined with the main liquid phase in a commingler 42, upstream of the booster pump 36. The pressure boosted liquid phase leaves the booster pump through a liquid line 44, via a non-return valve 46. A bypass line 48 that includes a bypass valve 50 extends from the inlet to the outlet of the booster pump 36.

The pressure boosted liquid phase is delivered though the liquid line 44 and a further non-return valve 52 to a first inlet of a commingler 54, where it is recombined with the increased pressure gas, which is fed to a second inlet of the commingler 54 from the outlet of the jet pump 30, via a gas line 56 and a non-return valve 58. The role of the commingler 54 is to combine the boosted gas and liquid phases efficiently for transportation of the mixture along a single outlet line 60. Alternatively a T-junction may be used to combine the two streams, although this option is less efficient and could cause a minor additional loss of pressure and can be used when both boosted liquid and gas phases have equal or nearly equal pressures.

Optionally, a pair of pressure control valves 70 and 71 may be provided downstream of the jet pump 30 and/or the booster pump 36 to equalise the pressures of the fluids before they are commingled in the commingler 54.

This system by the nature of its arrangement and design has the following main advantages.

It uses HP gas from an existing source that can provide a sustainable very high pressure gas as dictated by its application, such as gas lift for gas lifting LP wells.

The pressure of the HP gas remains high and does not drop during the field life, unlike situations when HP gas from existing high pressure wells is used (which is subject to decline in pressure during field life). Nevertheless, HP gas from HP wells can be used while the pressure of these walls is adequately high.

The boosting of the liquid phase is achieved by a booster pump that is designed and supplied for each specific application, and therefore its pressure boosting capability will not decline during the field life.

The combination of a jet pump using high pressure gas from a sustainable source and a booster pump that handles the liquid phase enables a much higher level of boost in pressure (dp) and/or a reduction on the back pressure of LP wells to be achieved. This, in turn, results in a much higher level of production from LP wells in comparison with other boosting systems that use fluid from HP wells as the motive flow.

The increase in production and recovery is achieved over a much longer period, as the sources of HP fluids (gas or liquid) are sustainable, unlike HP gas from some HP wells.

Figure 3:
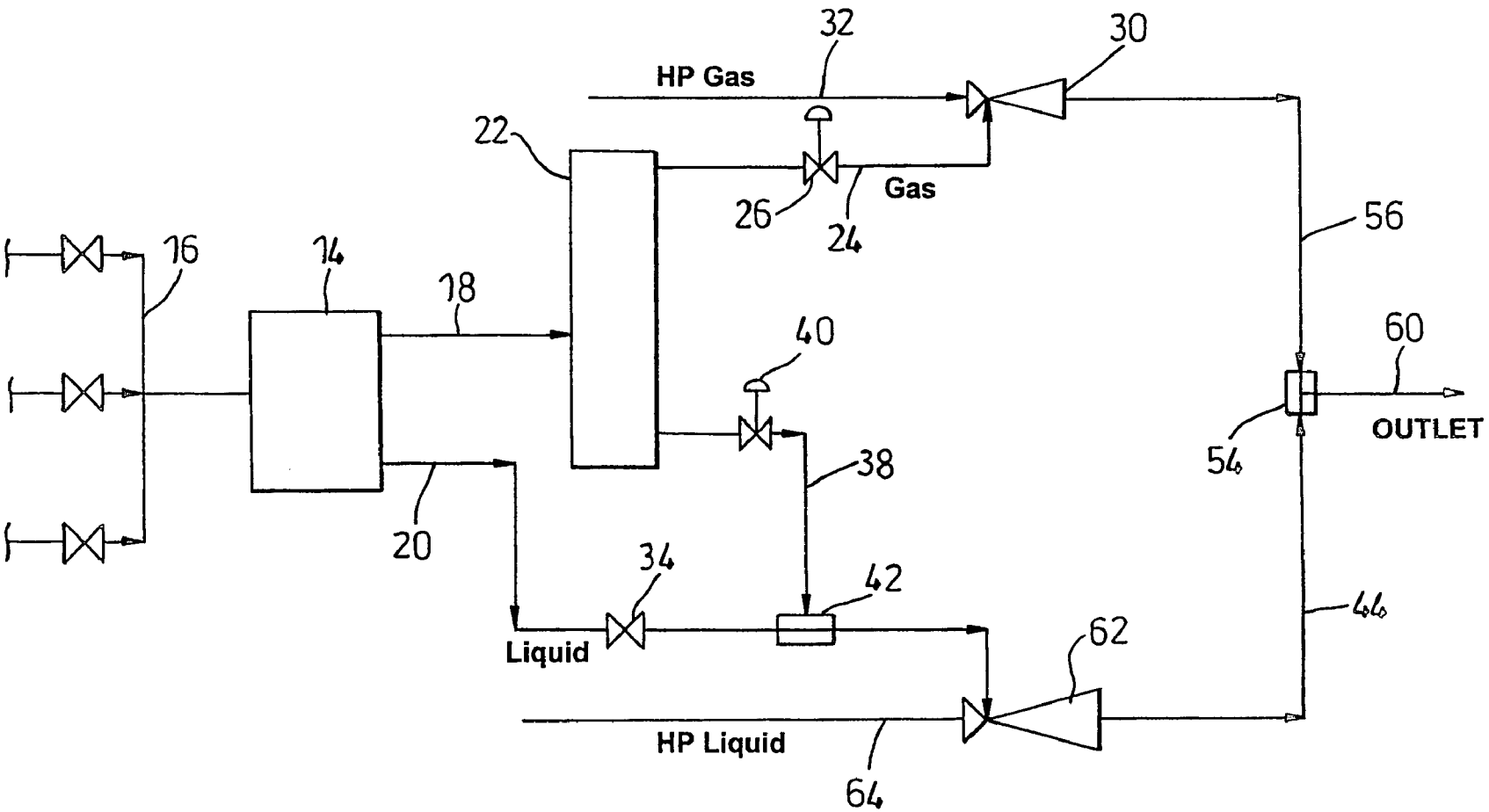
FIG. 3 illustrates an optional modification of the system shown in FIG. 2.

A modified form of the pressure boosting system described above is shown in FIG. 3. This modified system is suitable for use in situations where a high pressure liquid phase is available from other sources, such as water from a water injection system or export oil that has been boosted to a high pressure for export by pipeline. In this case the booster pump shown in FIG. 2 is not used and a much simpler and cheaper option, using a liquid-liquid jet pump 62, is adopted. The high pressure liquid phase is fed to the liquid-liquid jet pump 62 through a liquid line 64 and is used as the motive flow to boost the pressure of LP liquid phase. The other parts of the system are substantially as described above.

Figure 4:
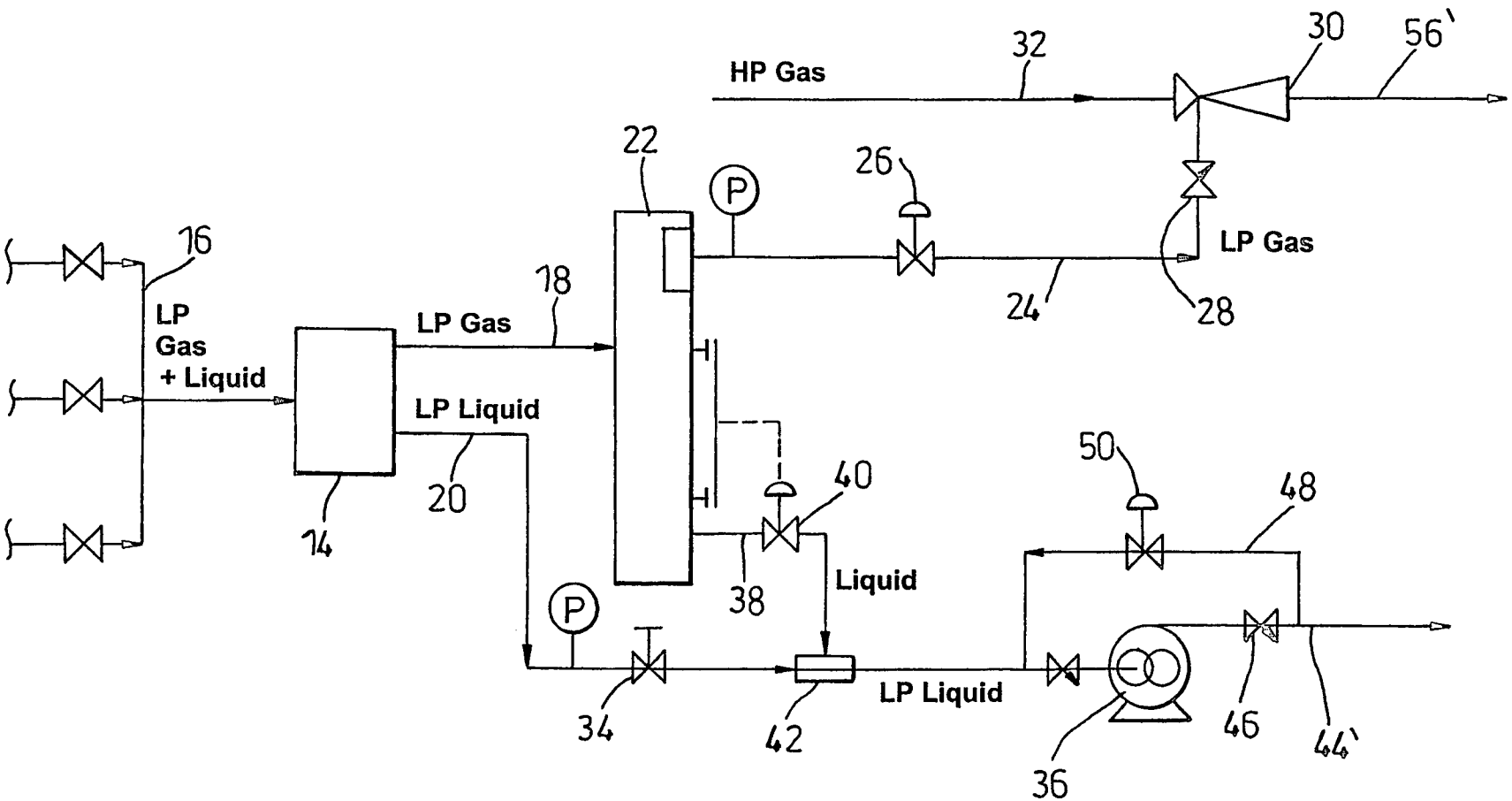
FIG. 4 illustrates a second optional modification of the system shown in FIG. 2.

A second modified form of the pressure boosting system described above is shown in FIG. 4. This modified system, is suitable for use in situations where the gas and liquid phases are to be stored or delivered separately. In this case the commingling device 54 is omitted and the HP gas and liquid phases are delivered separately through supply lines 56', 44' respectively. The other parts of the system are substantially as described above.

What is claimed is:

1. A system for pumping multiphase fluids, the system comprising:

a compressor that is constructed and arranged to receive gas from a gas source selected from the group consisting of lift gas, export gas, and underground steam and compress the gas to provide a HP gas supply having a pressure in the range 50-150 bar;

a cyclone-type phase separator that is connected to receive a LP multiphase fluid, and is constructed and arranged to separate a LP gas phase and a LP liquid phase from the LP multiphase fluid;

a knock-out vessel for removing retained liquid from the separated LP gas phase, having an inlet connected to receive the LP gas phase from the phase separator, a LP gas outlet and a LP liquid outlet;

a gas-gas jet pump having a LP inlet connected to receive the LP gas phase from the knock-out vessel, a HP inlet connected to receive a HP gas supply from the compressor, and an outlet for providing outlet gas at a pressure higher than that of the LP gas phase; and a liquid pump comprising a positive displacement pump having a LP inlet connected to receive the LP liquid phases from the phase separator and the knock-out vessel, and an outlet for providing outlet liquid at a pressure higher than that of the LP liquid phases.

2. The system according to claim 1, wherein the compressor provides a supply of lift gas or export gas.

3. The system according to claim 1, wherein the HP gas supply has a pressure at least twice that of the LP gas phase.

4. The system according to claim 1, wherein the gas-gas jet pump has an outlet pressure in the range 1.1 to 3.0 times the pressure of the LP multiphase fluid.

5. The system according to claim 1, wherein the liquid pump has an outlet pressure similar to that of the gas-gas jet pump.

6. The system according to claim 1, further comprising a mixing device connected to the outlets of the jet pump and the liquid pump, for combining the outlet gas and the outlet liquid and providing a combined multiphase outlet fluid at a pressure higher than that of the LP multiphase fluid.

7. The system according to claim 6, wherein the mixing device is a commingler.

8. The system according to claim 6, wherein the combined multiphase outlet fluid has an outlet pressure in the range 1.1 to 3.0 times that of the LP liquid phase.

9. The system according to claim 6, wherein the multiphase fluid is a petroleum gas/oil mixture.

10. The system according to claim 9, wherein the gas/liquid ratio of the petroleum gas/oil mixture is in the range 9 to 49 at the operating pressure and temperature.

11. A process for pumping multiphase fluids, the process comprising:

receiving gas from a gas source selected from the group consisting of lift gas, export gas, high pressure steam and underground steam and compressing the gas by means of a compressor to provide a HP gas supply having a pressure in the range 50-150 bar;

separating a LP multiphase fluid into a LP gas phase and a LP liquid phase using a cyclone-type phase separator;

removing retained liquid from the separated LP gas phase using a knock-out vessel;

increasing the pressure of the LP gas phase using a gas-gas jet pump, by supplying a HP gas supply from the compressor to a HP inlet of the jet pump and supplying the LP gas phase from the knock-out vessel to a LP inlet of the jet pump; and increasing the pressure of the LP liquid phases from the phase separator and the knock-out vessel using a positive displacement pump.

12. The process according to claim 11, wherein the compressor provides a supply of lift gas.

13. The process according to claim 11, wherein the compressor provides a supply of export gas.

14. The process according to claim 11, wherein the HP gas source supply has a pressure at least twice that of the LP gas phase.

15. The process according to claim 11, wherein the gas-gas jet pump has an outlet pressure in the range 1.1 to 3.0 times the pressure of the LP multiphase fluid.

16. The process according to claim 11, wherein the liquid pump has an outlet pressure in the range 1.1 to 3.0 times the pressure of the LP multiphase fluid.

17. The process according to claim 11, further comprising mixing the increased pressure gas and liquid phases to provide a combined multiphase fluid at a pressure higher than that of the LP multiphase fluid.

18. The process according to claim 17, wherein increased pressure gas and liquid phases are mixed in a commingler.

19. The process according to claim 17, wherein the combined multiphase outlet fluid has an outlet pressure in the range 1.1 to 3.0 times that of the LP multiphase fluid.

20. The process according to claim 17, wherein the multiphase fluid is a petroleum gas/oil mixture.

21. The process according to claim 20, wherein the gas/liquid ratio of the petroleum gas/oil mixture is in the range 9 to 49 at the operating pressure and temperatures.

22. A system for pumping multiphase fluids, the system comprising:

a compressor that is constructed and arranged to receive gas from a gas source selected from the group consisting of lift gas, export gas, high pressure steam and underground steam and compress the gas to provide a HP gas supply having a pressure in the range 50-150 bar;

a cyclone-type phase separator that is connected to receive a LP multiphase fluid, and is constructed and arranged to separate a LP gas phase and a LP liquid phase from the LP multiphase fluid;

a knock-out vessel for removing retained liquid from the separated LP gas phase, having an inlet connected to receive the LP gas phase from the phase separator, a LP gas outlet and a LP liquid outlet;

a gas-gas jet pump having a LP inlet connected to receive the LP gas phase from the knock-out vessel, a HP inlet connected to receive a HP gas supply from the compressor, and an outlet for providing outlet gas at a pressure higher than that of the LP gas phase;

a commingler connected to receive and combine the LP liquid phases from the cyclone-type phase separator and the knock-out vessel, and having an outlet for the combined LP liquid phases; and a liquid pump comprising a positive displacement pump having a LP inlet connected to receive the combined LP liquid phases from the commingler, and an outlet for providing outlet liquid at a pressure higher than that of the LP liquid phases.

23. A process for pumping multiphase fluids, the process comprising:

receiving gas from a gas source selected from the group consisting of lift gas, export gas, and underground steam and compressing the gas by means of a compressor to provide a HP gas supply having a pressure in the range 50-150 bar;

separating a LP multiphase fluid into a LP gas phase and a LP liquid phase using a cyclone-type phase separator;

removing retained liquid from the separated LP gas phase using a knock-out vessel;

increasing the pressure of the LP gas phase using a gas-gas jet pump, by supplying a HP gas supply from the compressor to a HP inlet of the jet pump and supplying the LP gas phase from the knock-out vessel to a LP inlet of the jet pump;

combining the LP liquid phases from the cyclone-type phase separator and the knock-out vessel in a commingler;

and increasing the pressure of the combined LP liquid phases using a positive displacement pump.

* * * * *